United States Patent [19]

Mullen et al.

[11] Patent Number: 4,804,118

[45] Date of Patent: Feb. 14, 1989

[54] FOOD DISPENSER WITH TIMER CONTROL

[75] Inventors: Joseph F. Mullen, Norristown; Stephen J. Sanderson, Royersford, both of Pa.

[73] Assignee: Portion Control Systems, Inc., Philadelphia, Pa.

[21] Appl. No.: 930,410

[22] Filed: Nov. 12, 1986

[51] Int. Cl.[4] ..... G04C 23/00

[52] U.S. Cl. ..... 222/641; 222/146.6; 222/504; 62/3

[58] Field of Search ..... 222/638-641, 222/146.6, 504, 206, 212; 62/3, 391; 251/7

[56] References Cited

U.S. PATENT DOCUMENTS

| | | | |
|---|---|---|---|
| 2,641,112 | 6/1953 | Muffly | 62/116 |
| 2,679,143 | 5/1954 | Helsing | 62/102 |
| 2,932,953 | 4/1960 | Becket | 62/3 |
| 2,943,452 | 7/1960 | Buchanan | 62/3 |
| 3,012,701 | 12/1961 | Weber | 251/7 X |
| 3,040,539 | 6/1962 | Gaugler | 62/3 |
| 3,149,471 | 9/1964 | Boehmer | 62/3 |
| 3,248,011 | 4/1966 | Brodsky et al. | 222/640 |
| 3,251,188 | 5/1966 | Dean et al. | 62/3 |
| 3,252,504 | 5/1966 | Newton | 165/2 |
| 3,351,233 | 11/1967 | Chanoch et al. | 62/3 |
| 3,445,039 | 5/1969 | Brodsky et al. | 222/640 |
| 3,821,881 | 7/1974 | Harkias | 62/3 |
| 4,089,184 | 5/1978 | Beitner | 62/3 |
| 4,176,671 | 12/1979 | Citrin | 251/7 X |
| 4,368,625 | 1/1983 | Platt | 62/378 |
| 4,450,987 | 5/1984 | Boettcher et al. | 222/641 |
| 4,453,652 | 6/1984 | Merkel et al. | 222/504 |
| 4,627,242 | 12/1986 | Beitner | 62/3 |
| 4,684,102 | 8/1987 | Dykstra | 251/7 |
| 4,776,074 | 6/1987 | Morgan, Jr. | 62/277 |

FOREIGN PATENT DOCUMENTS 3040490 5/1981 Fed. Rep. of Germany .

OTHER PUBLICATIONS

Advertisement for "Therm-a-pat" from the Progressive Corporation.

*Primary Examiner*—Micheal S. Huppert

*Attorney, Agent, or Firm*—Dann, Dorfman, Herrell and Skillman

[57] ABSTRACT

A food dispenser having a vessel for containing food, such as a beverage, is provided. A delivery conduit communicates with the vessel to deliver a flow of food from the vessel. A valve cooperates with the deliver conduit to open and close the delivery conduit to regulate the flow of food through the delivery conduit. A primary actuator is displaced from a first position to a second position to actuate the valve to ebable food to flow through the delivery conduit. Valve control circuitry connected with a source of power is responsive to actuation of the primary actuator for opening the valve to permit a flow of food through the delivery conduit during the period of time that the primary actuator is in the second position up to a selected time limit provided by primary actuator timer circuitry.

28 Claims, 3 Drawing Sheets

FIG. 1
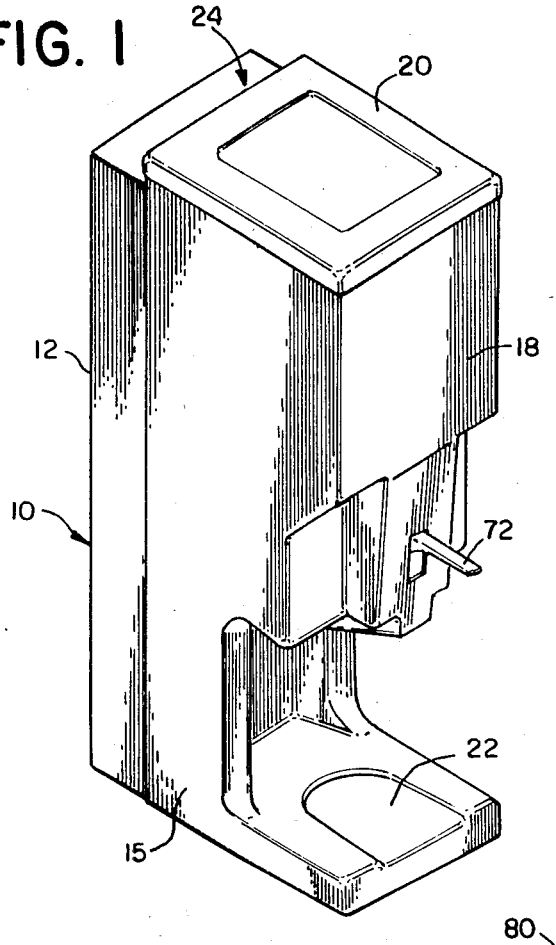
FIG. 2
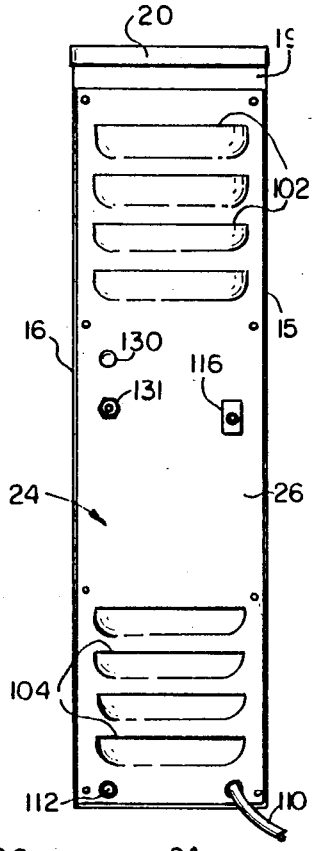
FIG. 3A
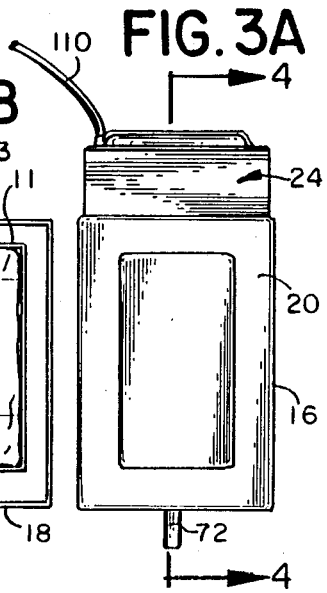
FIG. 3B
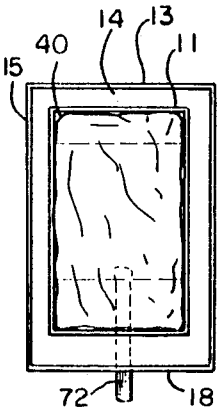
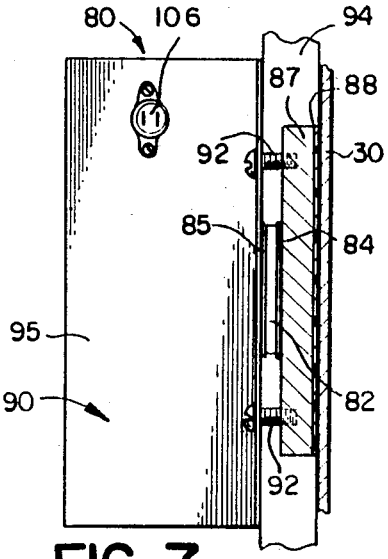
FIG. 7

FIG. 5
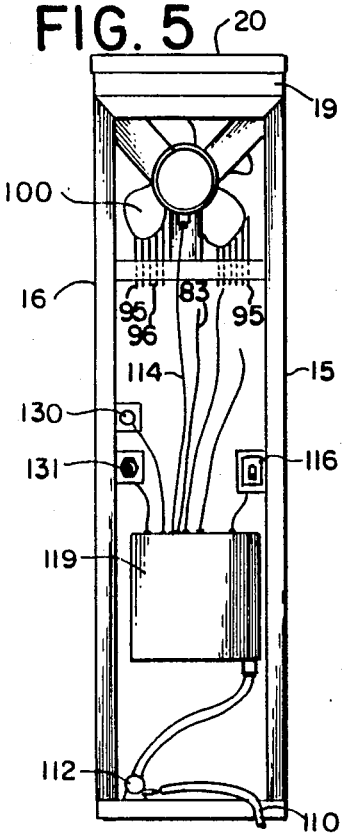
FIG. 4
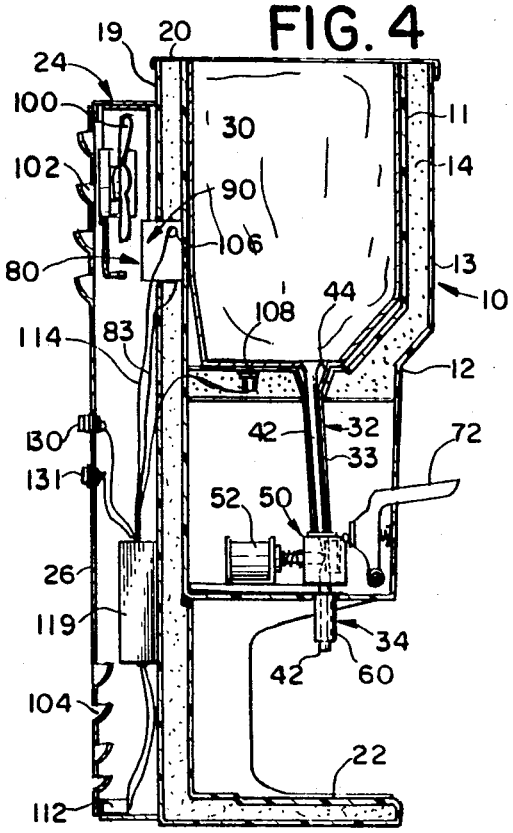
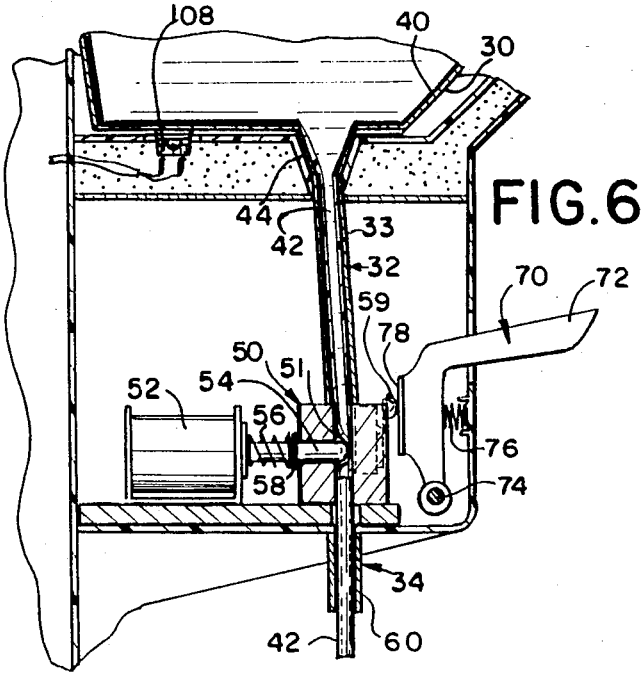
FIG. 6

FOOD DISPENSER WITH TIMER CONTROL

FIELD OF THE INVENTION

The present invention relates to a food dispenser and, more particularly, to a food dispenser having timer control for dispensing predetermined portions of food and especially liquid types of food, such as beverages or cream.

BACKGROUND OF THE INVENTION

Many food service establishments utilize food dispensers for dispensing predetermined measures or portions of food or drink. Conventional dispensers used in food service establishments enable a predetermined measure of a beverage to be dispensed upon actuation of the dispenser. A drawback with conventional dispensers, however, is that upon actuation, the conventional dispenser typically dispenses a predetermined measure of food or beverage regardless of whether a full measure is required to fill the cup or container. Unfortunately, when the conventional dispensers are used with carbonated beverages, the effervescence of the beverage being dispensed into the cup causes the beverage to often overflow the container. Accordingly, when the effervescnce subsists, less than a full measure of the beverage remains in the cup. Consequently, either a separate switch is required to enable the cup to be filled by manual control to the full measure or another full measure of the beverage must be dispensed in order to fill the cup with the excess portion of the beverage being wasted.

In still other applications, conventional beverage dispensers do not have the capability to dispense food either above or below a preset measure. As a result, either the preset measure must be continuously readjusted to accommodate different capacity cups or the preset measure of beverage must be dispensed until the cup is filled to capacity with the remaining beverage being wasted.

In accordance with applicant's unique invention, a food dispenser is provided which overcomes many of the drawbacks of conventional food dispensers. In accordance with applicant's invention, a food dispenser is provided which not only dispenses predetermined measures of food but also has the capability to permit drinking cups to be topped off with beverage. As a result, additional beverage beyond a preset measure may be added to oversize containers without any waste of product. Further, the food dispenser in accordance with the present invention has the additional capacity to dispense less than a preset measure to accommodate undersize cups without requiring any additional switches or any adjustment to the preset measure. The beverage is dispensed under circuit control rather than mechanical gear arrangements to provide a more efficient and reliable dispenser.

SUMMARY OF THE INVENTION

In accordance with the present invention, a food dispenser for storing and dispensing foods and particularly liquid types of food, such as beverages or cream, is provided. The food dispenser includes a frame and a vessel supported relative to the frame for containing the food. A delivery conduit is supported relative to the frame and communicates with the vessel to deliver a flow of food from the vessel.

valve means is supported relative to the frame and cooperates with the delivery conduit for regulating the flow of food through the delivery conduit. A primary actuator is provided for actuating the valve means to enable the food to flow through the delivery conduit. The food dispenser includes power input means which is connectable with a source of power to supply electrical power to the dispenser. Valve control circuitry is connected with the power input means and with the valve means. The valve control circuitry is responsive to the actuation of the primary actuator for opening the valve means to permit a flow of food through the delivery conduit during the period of time that the primary actuator is actuated up to a selected time limit. The valve control circuitry includes primary actuator timer circuitry for providing the selected time limit.

The valve control circuitry may also include primary force timer circuitry for enabling increased force to be supplied to the valve means for an initial predetermined time period following actuation of the primary actuator to facilitate the initial opening of the valve means. After the initial predetermined time period expires, the primary force timer circuitry enables reduced force to be supplied to the valve means so that the valve means is held open for the period of time that the primary actuator is actuated up to the selected time limit.

The food dispenser may also include a secondary actuator, such as a service switch, for actuating the valve means. The valve control circuitry is responsive to the actuation of the secondary actuator to enable electrical power to be supplied to the valve means to open the valve means for a predetermined time limit following actuation of the secondary actuator. The valve control circuitry includes secondary actuator timer circuitry for establishing the predetermined time limit.

To facilitate the opening of the valve means upon actuation of the secondary actuator, secondary force timer circuitry is provided to enable increased force to be supplied to the valve means for an initial predetermined time following actuation of the secondary actuator to facilitate the initial opening of the valve means. After the initial predetermined time expires, the secondary force timer circuitry enables reduced force to be supplied to the valve means so that the valve means is held open for the predetermined time limit established by the secondary actuator timer circuitry.

BRIEF DESCRIPTION OF THE DRAWINGS

The foregoing summary, as well as the following detailed description of the preferred embodiment of the present invention, will be better understood when read in conjunction with the accompanying drawings, in which:

FIG. 1 is a perspective view of a food dispenser in accordance with the present invention;

FIG. 2 is a rear elevational view of the food dispenser;

FIG. 3A is a plan view of the food dispenser;

FIG. 3B is a plan view of the food dispenser with the cover of the dispenser removed and a portion of the housing removed;

FIG. 4 is a sectional view of the food dispenser taken along line 4—4 of FIG. 3A;

FIG. 5 is a rear elevational view of the food dispenser similar to FIG. 2 but with the back panel of the food dispenser removed;

FIG. 6 is an enlarged sectional view, with parts broken away, of the food delivery system of the food dispenser shown in FIG. 4;

FIG. 7 is an enlarged side elevational view, with parts broken away, of a heat exchange assembly shown in FIG. 4 for regulating the temperature of the food within the dispenser.

DETAILED DESCRIPTION OF THE PREFERRED EMBODIMENT

Figure 8:
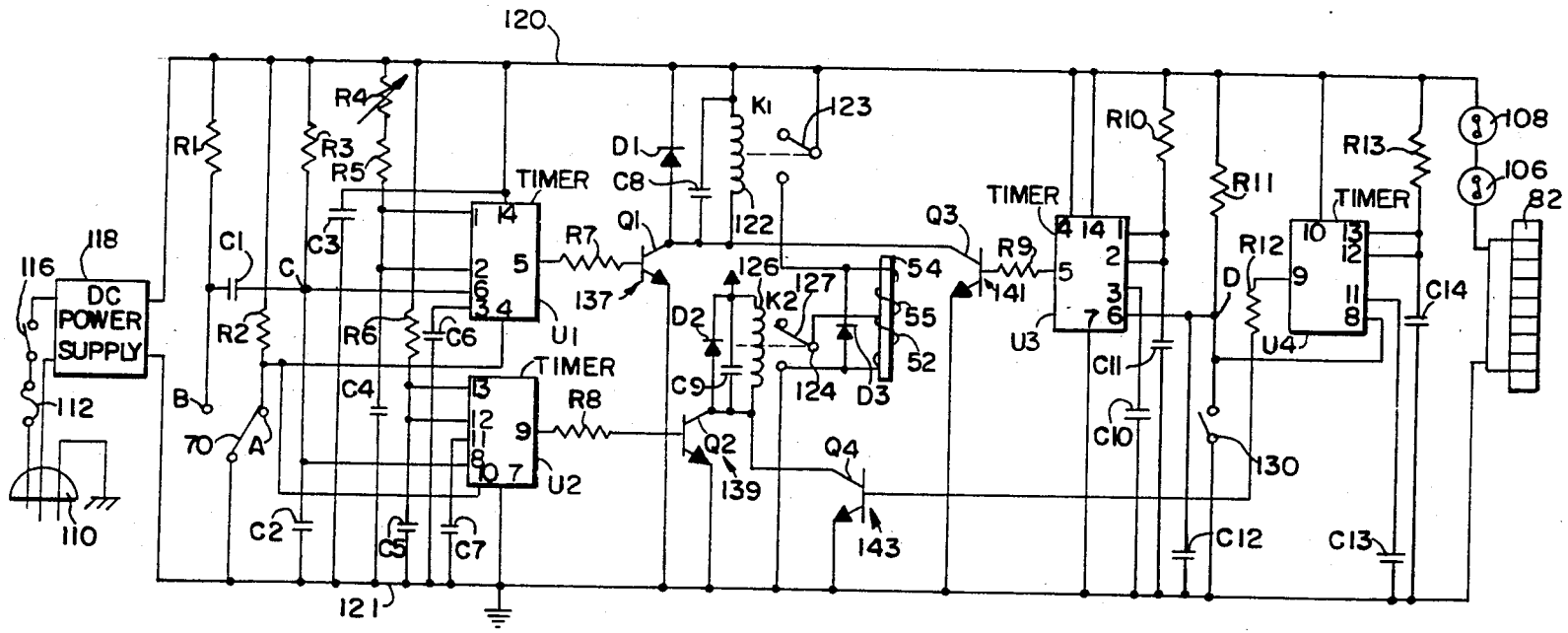
FIG. 8 is a general schematic circuit diagram of the preferred electrical circuitry for the food dispenser, but with the related circuitry for an exhaust fan omitted.

Referring to the drawings, a food dispenser, generally designated 10, for storing and dispensing food and particularly liquid types of food such as beverages and cream is depicted. The food dispenser 10 may also be used with various powdered foods which would have a tendency to flow under force of gravity. The food dispenser 10 includes a housing 12 which serves as a support frame for the internal operating mechanisms of the food dispenser. In applications where the temperature of the food within the dispenser is to be controlled, the housing 12 is desirably constructed of a thermally-insulative material. For example, as shown in FIG. 4, the housing may contain double inner and outer walls 11 and 13, respectively, with foam insulation 14 therebetween.

The housing 12 includes sidewalls 15 and 16, a front portion 18 and a back wall 19 and is configured to rest upon a generally flat surface such as a counter. A removable lid or cover 20 encloses the top portion of the housing. The lid 20 is preferably constructed of a thermally-insulative material to provide more efficient temperature control of the food within the dispenser. The housing also includes a support platform 22 at the bottom of the front portion 18 of the housing for receiving cups or other containers in proper position in a recessed area under the dispenser portion of the housing for convenient filling of containers with food dispensed from the food dispenser.

As shown in FIGS. 1 and 4, the housing 12 includes a back casing 24 fixed at the back wall 19 of the dispenser. The casing 24 houses the desired circuitry and temperature control apparatus for operating the dispenser and for controlling the temperature of the dispensed food. The casing 24 includes a removable back panel 26 which enables access to the interior of the casing 24.

Since the food dispenser 10 is desirably used with liquid types of food such as cream or wine, for example, the dispenser includes a vessel 30 supported within the housing for containing and storing the food to be dispensed. In applications where the temperature of the food is to be controlled by the dispenser, the vessel 30 is desirably constructed of a thermally-conductive material such as aluminum. The food is introduced into the vessel 30 by removing lid 20 giving access to the vessel. To permit the food to be dispensed from te dispenser, a delivery conduit generally designated 32, supported relative to the housing communicates with a bottom portion 44 of the vessel 30 for delivering a flow of food from the vessel to the dispenser outlet, generally designated 34. If desired, the bottom portion 44 of the vessel 30 may be contoured to facilitate flow of food toward delivery conduit 32.

In operation, a beverage may be poured directly into the vessel 30 from which the beverage may be dispensed to the dispenser outlet 34 through a rigid generally tubular guide 33 integrally connected at the bottom portion 44 of the vessel 30. As such, the guide 33 serves as a part of the delivery conduit 32. Alternatively, in order to improve sanitation and to reduce the time needed for cleanup, a beverage or food container 40, with either rigid or deformable walls, serving as a liner for the vessel 30, may be inserted into the vessel 30 so that the beverage within the container 40 does not directly contact the walls of the vessel 30. When a container 40 is employed, there is preferably provided a resiliently deformable delivery tube 42 integral with the container 40 to serve as a part of the delivery conduit 32 of the dispenser. To permit the delivery tube 42 of the container 40 to be more easily inserted into the dispenser, the bottom portion 44 of the vessel is also funneled at the delivery conduit 32. Accordingly, the end of the delivery tube 42 may be inserted through the funneled bottom portion 44 of the vessel 30 and through the aligned generally tubular guide 33 of the delivery conduit 32. The guide 33 terminates at a valve assembly 50, which regulates the flow of food through delivery conduit 32. To permit a flow of food, the valve assembly 50 includes a generally tubular passageway 51 which serves as a part of the delivery conduit 32. The passageway 51 extends through the valve assembly 50 and is aligned in registry with the generally tubular guide 33 so that the delivery conduit 42 of the container 40 can be passed through the passageway 51 of the valve assembly. After emerging from a bottom portion of the valve assembly 50 the delivery tube 42 is passed through a protective sleeve 60 at the dispenser output 34. The sleeve 60 provides an index for determining where any excess length of the delivery tube 42 should be cut off. Sleeve 60 also serves to align the delivery tube 42 so that the flow of beverage from the dispenser is properly directed into the cup or container to be positioned on the container platform 22 of the housing.

The valve assembly 50 is supported relative to the housing in position to cooperate with the delivery conduit 32 to regulate the flow of food through the delivery conduit 32. For this purpose, the valve assembly 50 includes an electrically powered pinch valve solenoid 52 supported within the housing 12. The pinch valve solenoid includes a central rod 54 which reciprocates axially through solenoid coil 55 between open and closed positions relative to the delivery conduit 32 in response to movement of a primary actuator, generally designated 70. The central rod 54 reciprocates in a direction generally transverse to the delivery tube 42 passing through the passageway 51 of the valve assembly 50. In operation, the central rod 54 has a normally closed position in which the rod projects into passageway 51 and bears against and compresses the deformable delivery tube 42 to pinch the tube together to stop the flow of food through the delivery tube. In the open position, the central rod 54 is retracted out of the passageway 51 to thereby enable food from the vessel 30 to flow through the delivery conduit 32 and out of the outlet 34 of the food dispenser.

The central rod 54 is normally held in a closed position pinching the delivery tube 42 together to prevent the flow of food by a coaxial biasing spring 56 carried on the central rod 54. The spring 56 is compressed to bear against a diametric pin 58 carried on the central rod 54 so as to bias the central rod into its closed position. The central rod 54 is moved through solenoid coil 55 toward its open position against the bias of spring 56 in response to movement of the primary actuator 70.

The primary actuator 70 includes a depressable actuator handle 72 which is pivotably mounted on shaft 74 carried in the housing. The handle 72 is spring biased by spring 76 so that a cam surface 78 of the actuator handle 72 bears against a spring trigger pin 59 on the valve assembly 50 to hold the trigger pin 59 in a fully depressed position. When the actuator handle 72 is depressed downwardly as shown in FIG. 6 against the bias of spring 76, the handle 72 rotates about pivot pin 74, thereby moving the cam surface 78 away from triggering pin 59. As the cam surface 78 moves away from triggering pin 59, the spring-loaded triggering pin is permitted to move from its retracted position into a second position projecting from the valve assembly 50. The movement of triggering pin 59 into its second position causes the pinch valve solenoid 52 to respond by retracting the central rod 54 against the bias of spring 56 to its open position out of passageway 51, thereby enabling food to flow from the vessel 30 through the delivery tube 42.

In order to maintain effective temperature control of the food within the vessel 30, an electrically-powered heat exchange system is thermally coupled with the vessel 30 to enable heat transfer between the heat exchange system and the vessel. In the present arrangement, the heat exchange system serves to cool the vessel 30 to refrigerate the food contained within the vessel. It should be appreciated, however, that the heat exchange system could be utilized to heat the vessel, if desired, for certain food products, such as melted cheese. To effect the necessary heat transfer for proper temperature control, a heat exchange assembly 80, is positioned internally of casing 24 and is thermally coupled with the vessel 30. As shown most clearly in FIG. 7, the heat exchange assembly 80 includes an electrically-powered thermoelectric heat transfer module 82 for converting electrical power to thermal energy. The heat transfer module 82 is a generally flat, two-sided electrical device which is electrically connected with a source of electrical power by conductor 83 as shown in FIGS. 4 and 5. The electrical power supplied to the module 82 is converted into thermal energy so that a first side 84 of the module 82 becomes cool in order to extract heat and a second side 85 of the module becomes hot in order to radiate heat.

In order to cool the food within the vessel 30, the cool side 84 of the module 82 is thermally coupled with the vessel 30. To increase the thermal coupling between the cool side 84 of the module and the thermally-conductive vessel 30, a thermally-conductive shoe 87 is positioned intermediate the module 82 and the vessel 30. The shoe 87 is positioned in direct and thermal contact with the cool side 84 of the module 82 and in thermal contact with the vessel 30. As shown in FIG. 7, the thermally-conductive shoe 87 is secured to a surface of the vessel 30 by a thermally-conductive adhesive 88.

In order to facilitate heat radiation from the hot side 85 of the module 82, a heat sink, generally designated 90, is held in thermal contact with the hot side 85 of the module. Screws 92 are passed through the heat sink 90 and are screwed into the thermally-conductive shoe 87 to hold the thermoelectric module 82 in compression between the heat sink 90 and the shoe 87. As a result, the module 82 is held in effective thermal contact with the shoe 87 and the heat sink 90. A thermally-insulative layer 94 is applied to enclose and surround the module 82 to thermally isolate the vessel 30 from the heat sink 90. The insulative layer 94 preferably comprises a liquid impermeable material to prevent liquid or water from contacting the module 82. Since water or condensation may adversely affect the performance of the module 52, the insulative layer 94 provides a water-tight barrier to keep the module 82 dry.

To increase heat radiation away from the module 82, the heat sink 90 includes a series of heat radiating fins 95, as best shown in FIG. 5, which project away from the hot side 85 of the module 82 into the air space within the casing 24. The fins 95 are generally planar plates constructed of a thermally-conductive material, such as aluminum. The fins 95 are oriented generally parallel to one another and are spaced apart from one another to provide air channels 96 for free flow of air between the respective fins 95.

In order to increase the radiation of heat from the fins 95 of the heat sink 90 to ambient air, the heat exchange system includes an air pump in the form of an electrically-powered axial fan 100. The fan 100 is supported on the back panel 26 of the casing 24 in position for creating a flow of ambient air through the heat sink 90.

As best illustrated in FIG. 4, the heat exchange assembly 80 is mounted onto the thermally-conductive vessel 30 generally internally of the casing 24 of the housing 12. The heat exchange assembly 80 is generally enclosed within the casing 24 of the housing 12 thereby requiring heat to be exhausted from the casing 24 to permit efficient operation. For this purpose, the fan 100 is fixed internally of the casing 24 on the removable back panel 26 in registry with an air outlet opening 102 through the back panel 26, as shown in FIGS. 2 and 4. Air inlet openings 104 for the casing 24 are provided at the bottom portion of the removable back panel 26.

In operation, the electrically-powered fan 100 causes an intake of ambient air to flow into the casing 24 of the housing through the air inlet openings 104. The ambient air is then forced through the heat sink 90 of the heat exchange assembly 80. As air is forced through the heat sink 90, the air flows through the air channels 96 between the heat radiating fins 95 so that heat from the fins 95 is efficiently radiated to the flow of ambient air. The heated ambient air is then exhausted by the fan 100 through the air outlet openings 102 in the casing 24.

In order to prevent the heat exchange assembly 80 from overheating, a thermostat 106 is fixed to the outer surface of one of the heat radiating fins 95. The thermostat 106 functions to detect when the temperature on the heat radiating fin 95 exceeds an upper predetermined limit which causes the thermostat to interrupt the supply of power to the thermoelectric module thereby enabling the unit to cool. Likewise, a thermostat 108 is positioned in contact with the vessel 30 to detect when the temperature of the vessel drops below a lower predetermined temperature limit. When the temperature of the vessel drops below the lower temperature limit, the thermostat disconnects the thermoelectric module 82 from the power supply to prevent further cooling of the vessel 30.

Since the fan 100, the thermoelectric module 82, the thermostats 106 and 108 and the pinch valve solenoid 52 require electrical power, the dispenser includes power input circuitry for providing electrical power to the dispenser. The dispenser 16 includes a power input cord 110 for connection with a source of AC power. To protect the operating circuitry of the dispenser, the input cord 110 is in turn connected with a fuse 112. The fan 100 is connected with the source of AC power by conductor 114, as shown in FIGS. 4 and 5. To control the input of power to the dispenser, a power input switch 116 is connected with the power input cord 110 in series with fuse 112 to switch the power through the dispenser on and off.

In order to provide a requisite DC power input to the dispenser, the dispenser includes an unregulated DC power supply 118 inside circuit box 119 connected with the power input cord 110. As shown in the schematic circuit diagram of FIG. 8, the DC power supply 118 includes DC power output lines 120 and 121 with output line 120 having a positive DC voltage relative to line 121. The DC output lines 120 and 121 enable the desired DC power to be supplied to the thermoelectric module 82. As shown in FIG. 8, thermostats 106 and 108 are connected in series with the thermoelectric module 82 across the DC output lines 120 and 121.

In order to provide input power to the pinch valve solenoid 52, as well as the desired control over the operation of the pinch valve solenoid, the dispenser 10 includes valve control circuitry shown in FIG. 8 connected with the pinch valve solenoid 52 and with the power output lines 120 and 121 of the DC power supply 118. In operation of the dispenser, the valve control circuitry is responsive to the actuation of the primary actuator 70 for opening the central rod 54 of the pinch valve solenoid 52 to permit a flow of food through the delivery conduit 32 during the period of the time that the primary actuator 70 is actuated up to a selected time limit provided by primary actuator timer circuitry. The valve control circuitry also includes primary force timer circuitry shown in FIG. 8 for enabling increased pulling or actuating force to be supplied to the central rod 54 of the pinch valve solenoid 52 for an initial predetermined time period following actuation of the primary actuator 70 to facilitate the initial opening of the pinch valve solenoid. The primary force timer circuitry also enables reduced force to be supplied to the central rod 54 of the solenoid after the initial predetermined time period expires so that the central rod 54 of the pinch valve solenoid is held open for the period of time that the primary actuator is actuated up to the selected time limit.

In order to permit an empty container 40 to be removed from the vessel 30 and a fresh container filled with beverage to be inserted into the vessel 30, the food dispenser includes a service switch 130, shown in FIG. 5, which serves as a secondary actuator for the pinch valve solenoid 52. The valve control circuitry shown in FIG. 8 is responsive to the actuation of the secondary actuator 130 to enable electrical power to be supplied to the pinch valve solenoid 52 to actuate the central rod 54 of the pinch valve solenoid 52 to an open position relative to delivery conduit 32 for a predetermined time limit following actuation of the secondary actuator 130. The valve control circuitry includes secondary actuator timer circuitry shown in FIG. 8 for providing the predetermined time limit. To facilitate the initial opening of the central rod 54 of the pinch valve solenoid 52 upon actuation of the secondary actuator 130, the valve control circuitry includes secondary force timer circuitry shown in FIG. 8 enabling increased pulling or actuating force to be supplied to the central rod 54 of the pinch valve solenoid 52 for an initial predetermined time following actuation of the secondary actuator 130. This initial actuation force facilitates the initial opening of the central rod 54 of the pinch valve solenoid 52. The secondary force timer circuitry shown in FIG. 8 enables reduced pulling force to be supplied to the central rod 54 of the solenoid 52 after the initial predetermined time expires so that the central rod 54 of the pinch valve solenoid 52 is held in open position for the predetermined time limit provided by the secondary actuator timer circuitry.

In order to open and close the pinch valve solenoid 52 by actuation of the primary actuator 70, the valve control circuitry shown in FIG. 8 includes a triggering circuit for the primary actuator 70. As shown in FIG. 8, the primary actuator 70 is connected with output line 121 and is switchable between a first position in contact with terminal A and a second position in contact with terminal B. Terminal A is connected to output line 120 through load resistor R2 and terminal B is connected with output line 120 through load resistor R1. The triggering circuit also includes a resistor R3 connected in series with capacitor C2 across the output lines 120 and 121. One side of a capacitor C1 is connected with a junction C positioned intermediate resistor R3 and capacitor C2 and the other side of the capacitor C1 is connected with terminal B of primary actuator 70.

To provide time-controlled actuation of the pinch valve solenoid 52 in response to the movement of the primary actuator 70 between terminals A and B, the primary actuator timer circuitry includes a timer circuit U1 configured from one of the dual timers of a 556 timer chip. The primary force timer circuitry includes timer circuit U2 which is the other dual timer from the 556 timer chip. To permit the timers U1 and U2 to respond to the primary actuator 70, junction C of the triggering circuit is connected to triggering input pin 6 on timer U1 and triggering input pin 8 on timer U2. Pin 14 on timer U1 is connected with output line 120 and also with output line 121 through capacitor C3. Biasing capacitor C6 connects pin 3 of timer U1 with output line 121 and biasing capacitor C7 connects pin 11 of timer U2 with output line 121. Pin 7 of timer U2 is also connected directly to output line 121.

Timers U1 and U2 each include resets in order to enable each of the timers to be reset before timing out. For this purpose, terminal A of the primary actuator is connected with reset pin 4 of timer U1 and with the reset pin 10 of timer U2. When a triggering input is supplied to input pin 6 of timer U1, the timer U1 will produce a timed output signal at pin 5 for a selected time limit established by timer U1, unless prior to timing out a reset signal is supplied to pin 4 of timer U1. The duration of the output signal produced on output pin 5 is controlled by a variable resistor R4, a fixed resistor R5 and a capacitor C4 connected in series across output lines 120 and 121. Pins 1 and 2 of timer U1 are connected intermediate the resistor R5 and capacitor C4 so that the selected time limit of U1 can be set. Variable resistor R4 is in the form of a potentiometer having an adjustment screw 131 as shown in FIGS. 4 and 5, which permits the magnitude of the resistance R4 to be changed to enable the selected time limit at which timer U1 times out to be changed, for example, between 1 and 11 seconds.

The initial predetermined time period at which timer U2 times out is controlled by resistor R6 and capacitor C5 connected in series across output lines 120 and 121. Input pins 12 and 13 of timer U2 are connected intermediate resistor R6 and capacitor C5 to control the timed output produced on pin 9 of timer U2 when a triggering input is received at pin 8. The magnitude of resistor R6 and capacitor C5 may be selected, for example, so that timer U2 times out at approximately 1 second.

In order to trigger the pinch valve solenoid 52 in response to a timed output signal produced at pin 5 of timer U1, the valve control circuitry includes primary actuator switch means generally designated 137 responsive to the primary actuator timer circuitry for connecting the solenoid 52 with the power input supplied on lines 120 and 121 in order to supply power to the solenoid to open the delivery conduit during the period of time that the primary actuator is actuated up to the selected time limit provided by timer U1. For this purpose, the primary actuator switch means includes a switching transistor Q1 having main collector and emitter terminals, and a base connected with the output pin 5 of timer U1 through current-limiting resistor R7. The switching transistor Q1 is responsive to the timed output signal on pin 5 of timer U1 to switch the transistor Q1 into a conductive state during the period of time that the primary actuator 70 is actuated, or switched from terminal A to terminal B, and up to the selected time limit provided by timer U1. The primary actuator switch means also includes a relay K1 having a relay coil 122 connected in series with the main terminals of the switching transistor and a relay contact 123 connected in series with the pinch valve solenoid 52. More specifically, the relay coil 122 is connected with output line 120 and the collector of switching transistor Q1. The emitter of transistor Q1 is in turn connected with output line 121. To dissipate stored energy, capacitor C8 and diode D1 are connected between output line 120 and the collector of transistor Q1 in parallel with relay coil 122. The pinch valve solenoid 52 is connected in series with the relay contact 123 across output lines 120 and 121 and diode D3 is connected across the terminals of the pinch valve solenoid. In this arrangement, the relay coil 122 is energized to close the relay contact 123 and connect the pinch valve solenoid 52 with the power input across output lines 120 and 121 to open the delivery conduit during the period of time that the primary actuator is actuated, or switched from terminal A to terminal B, and up to the selected time limit.

As shown in FIG. 8, the pinch valve solenoid 52 includes a center tap terminal 124. To facilitate the initial movement of the central rod 54 of the pinch valve solenoid 52 to initially open the delivery conduit 32, the valve control circuitry includes primary force switch means, generally designated 139, connected with the center tap 124 of the solenoid and an end of the solenoid. The primary force switch means is responsive to the primary force timer circuitry and specifically to timer U2 to electrically short-circuit a portion of the pinch valve solenoid for an initial predetermined time period following actuation of the primary actuator 70 to provide an increased pulling or actuating force on the central rod 54. The increased actuating force facilitates the initial opening of the rod 54 against the bias of the spring 56. The primary force switch means also removes the short-circuit to reduce the pulling force on the rod after the initial predetermined time period expires, as the reduced force is all that is necessary to thereafter hold the rod, so that the rod is held in the open position against the bias of the spring 56 for the period of time that the primary actuator 70 is actuated up to the selected time limit of between 1 and 11 seconds. For this purpose, the primary force switch means includes a switching transistor Q2 having main collector and emitter terminals, and a base connected with the output pin 9 of timer U2 through current limiting resistor R8. The switching transistor Q2 is responsive to the timed output signal produced on pin 9 of timer U2 upon actuation of primary actuator 70 to switch the transistor Q2 into a conductive state during the initial predetermined time period following actuation of the primary actuator 70.

The primary force switch means also includes a relay K2 having a relay coil 126 connected with the collector of switching transistor Q2 and the output line 120. The emitter of transistor Q2 is connected to output line 121. In order to dissipate stored energy, diode D2 and capacitor C9 are connected between the output line 120 and the collector of switching transistor Q2 in parallel with the relay coil 126. The relay coil K2 also includes a relay contact 127 connected with the center tap terminal 124 and an end of the solenoid 52 so that the relay coil 126 is energized to close the relay contact 127 to electrically short-circuit a portion of the solenoid 52 to provide the increased pulling or actuating force on the central rod 54 during the initial predetermined time period, such as one second, provided by timer U2 following actuation of the primary actuator 70.

As previously mentioned, the dispenser 10 also includes a secondary actuator 130 which functions as a service switch. In order to control the operation of the pinch valve solenoid 52, the secondary actuator 130 includes triggering circuitry. The secondary actuator 130 is connected in series with resistor R11 across output lines 120 and 121 and a connection junction D is positioned intermediate the actuator 130 and resistor R11. A triggering capacitor C12 is connected across the secondary actuator 130 between connection junction D and output line 121.

In order to provide the predetermined time limit for which the pinch valve solenoid 52 is opened following actuation of the secondary actuator 130, the secondary actuator timer circuitry includes a timer circuit U3 which is provided as one of the dual timers of a second 556 timer chip. In addition, to facilitate the initial opening of the pinch valve solenoid 52 in response to actuation of the secondary actuator 130, the secondary force timer circuitry includes timer circuit U4 which is provided as the other dual timer of the second 556 timer chip. To trigger the respective timers U3 and U4, junction D of the triggering circuit for the secondary actuator is connected with input triggering pin 6 of timer U3 and input triggering pin 8 timer U4. Pins 4 and 14 of timer U3 are connected with output line 120 and pin 7 of timer U3 is connected with output line 121. Pin 3 of timer U3 is connected with output line 121 through biasing capacitor C10. Upon receiving a triggering signal at input pin 6, timer U3 produces an output signal on output pin 5 for a predetermined time limit such as 1 minute. The predetermined time limit is controlled by resistor R10 and capacitor C11 connected in series across output lines 120 and 121. Pins 1 and 2 of timer U3 are connected intermediate resistor R10 and capacitor C11. The values of resistor R10 and capacitor C11 are chosen so that timer U3 produces an output signal on pin 5 for approximately 1 minute after receiving a triggering input signal at pin 6.

Pin 10 of timer U4 is connected with output line 120 and pin 11 of timer U4 is connected with output line 121 through biasing capacitor C13. Upon receiving a triggering input at pin 8, timer U4 produces a timed output signal on pin 9 for an initial predetermined time, such as 1 second, established by resistor R13 and capacitor C14.

Resistor R13 and capacitor C14 are connected in series across output lines 120 and 121 and pins 12 and 13 of timer U4 are connected intermediate resistor R13 and capacitor C14.

In order to connect the solenoid with a power input supplied on output lines 120 and 121 to open the delivery conduit 32 in response to the actuation or closing of secondary actuator 130, the valve control circuitry includes secondary actuator switch means, generally designated 141, responsive to the secondary actuator timer circuitry. The secondary actuator switch means is responsive to the secondary actuator timer circuitry to energize the solenoid 52 to open the delivery conduit 42 for the predetermined time limit, such as one minute provided by the secondary actuator timer circuitry and particularly timer U3 following actuation of the secondary actuator. For this purpose, the secondary actuator switch means includes a switching transistor Q3 having main collector and emitter terminals, and a base connected with the output pin 5 of timer U3 through current limiting resistor R9. The switching transistor Q3 is responsive to an output pulse on pin 5 of timer U3 for switching the transistor Q3 into a conductive state for the predetermined time limit provided by timer U3 of the secondary actuator timer circuitry following actuation of the secondary actuator 130. The secondary actuator switch means also includes relay K1 having the relay coil 122 connected in series with the collector of switching transistor Q3, while the emitter of transistor Q3 is connected with output line 121. Since the relay contact 123 is connected in series with the pinch valve solenoid 52, the relay coil 122 is energized to close the relay contact 123 and connect the pinch valve solenoid 52 with power input supplied on output lines 120 and 121 to open the delivery conduit 32 for the predetermined time limit, such as 1 minute, provided by timer U3 of the secondary actuator timer circuitry following actuation of the secondary actuator 130.

In order to facilitate the opening of the solenoid 52 in response to actuation of the secondary actuator, the valve control circuitry includes a secondary force switch means, generally designated 143, connected with the center tap terminal 124 of the solenoid 52 and an end of the solenoid. The secondary force switch means is responsive to the secondary force timer circuitry to electrically short-circuit a portion of the solenoid for an initial predetermined time, such as 1 second, provided by timer U4 following actuation of the secondary actuator. Short-circuiting a portion of the solenoid provides an increased pulling or actuating force on the central rod 54 to facilitate the initial opening of the rod against the bias of the spring 56. The secondary force switch means functions to remove the short to reduce the pulling force on the rod 54 after the initial predetermined time provided by timer U4 expires to thereby permit a lesser force to hold the rod in the open position against the bias of the spring 56 for the predetermined time limit of about 1 minute provided by timer U3 of the secondary actuator timer circuitry. For this purpose, the secondary force switch means includes a switching transistor Q4 having main collector and emitter terminals, and a base connected with the output pin 9 of timer U4 through current limiting resistor R12. As such, the switching transistor Q4 is responsive to a timed output signal on pin 9 of timer U4 for switching the transistor Q4 into a conductive state during the initial predetermined time provided by timer U4 following actuation of the secondary actuator 130. The main terminals of the switching transistor Q4 are connected in series with relay coil 126 so that the relay coil 126 is energized to close the relay contact 127 to electrically short-circuit a portion of the solenoid 52 to provide increased pulling or actuating force on the central rod 54 during the initial predetermined time of about 1 second provided by timer U4 following actuation of the secondary actuator 130.

During operation of the dispenser, the valve control circuitry operates to control the opening of the pinch valve solenoid 52 for approximately 1 to 11 seconds depending on the selected adjustment of variable resistor R4. When the primary actuator 70 is switched from position A to position B, a negative current triggering signal is supplied to triggering pin 6 of timer U1 and to triggering pin 8 of timer U2. As such, timers U1 and U2 are triggered so that timer U1 produces a timed output signal on pin 5 of duration between 1 and 11 seconds and timer U2 produces a timed output signal on pin 9 of about 1 second duration. Timers U1 and U2 generate output signals for their respective time periods unless the primary actuator 70 is switched from position B back to position A thereby resetting timers U1 and U2 before the respective timers U1 and U2 time out. If the primary actuator 70 is not switched from position B back to position A, both timers U1 and U2 will be permitted to go through their respective time cycles and thereby produce the timed output signals of the selected durations.

When the output signals are generated by timers U1 and U2, switching transistors Q1 and Q2 saturate causing current to flow through the respective relay coils 122 and 126 of relays K1 and K2, thereby causing the respective relay contacts 123 and 127 to close. Since timer U2 causes a portion of the solenoid 52 to short-circuit for approximately 1 second, an increased pulling force is provided on the central rod of the solenoid 52 to overcome the initial inertia of the rod 52 . Once the initial inertia is overcome, timer U2 times out causing relay contact 127 to open, thereby removing the short-circuit so that a reduced pulling force is supplied to the central rod during the remaining time duration provided by timer U1. Once relay K2 opens, relay K1 will continue to supply current to the solenoid 52 until the output of U1 goes low after the selected time limit of approximately 1 to 11 seconds expires. In this arrangement, the selected time limit provided by timer U1 controls the amount of time that the delivery conduit 32 is opened to enable a predetermined measure or portion of liquid in the vessel to be dispensed into a cup or other container.

Timers U3 and U4 operate in a manner similar to timers U1 and U2, except that the timed output of timer U3 is held constant at about 1 minute and neither of the timers U3 or U4 are resettable. Consequently, when the secondary actuator 130 is closed, triggering inputs are supplied to timers U3 and U4 so that timers U3 and U4 produce respective timed output signals which cause switching transistors Q3 and Q4 to saturate. Timer U4 produces an output signal for approximately 1 second in order to electrically short-circuit a portion of the solenoid 52 to provide an increased pulling force on the central rod 54 to overcome the initial inertia of the rod. After timer U4 times out, timer U3 continues to cause transistor Q3 to saturate so that electrical current is supplied to the solenoid 52 for the time period provided by the timer U3, which, for example may be approximately 1 minute to permit servicing of the dispenser.

From the foregoing description and the accompanying drawings, it can be seen that the present invention provides a food dispenser which is extremely versatile and efficient to operate and use. It should be recognized that changes or modifications may be made to the dispenser without departing from the broad inventive concepts of the invention. It is understood, therefore, that the invention is not limited to the particular embodiment described herein, but is intended to cover all changes and modifications which are within the scope and spirit of the invention as set forth in the appended claims.

What is claimed is:

1. A food dispenser comprising:

(a) a frame;

(b) a vessel supported relative to the frame for containing food;

(c) a delivery conduit supported relative to the frame communicating with the vessel for delivering a flow of food from the vessel;

(d) valve means supported relative to the frame cooperating with the delivery conduit for regulating the flow of food through the delivery conduit;

(e) a primary actuator displaceable from a first position to a second position for actuating the valve means to enable a flow of food through the delivery conduit;

(f) power input means for providing a supply of electrical power; and (g) valve control circuitry connected with the power input means and the valve means responsive to displacement of the primary actuator to its second position for opening the valve means to enable a flow of food through the delivery conduit during the period of time that the primary actuator is in said second position up to a selected time limit, the valve control circuitry having primary actuator timer circuitry for determining the selected time limit, said time circuitry being resettable by a reset signal, (h) displacement of the primary actuator to its first position providing a reset signal in said circuitry.

2. The food dispenser in accordance with claim 1 wherein the valve control circuitry includes primary force timer circuitry for enabling increased force to be supplied to the valve means for an initial predetermined time period following actuation of the primary actuator to facilitate the initial opening of the valve means and for enabling reduced force to be supplied to the valve means after the initial predetermined time period expires, whereby the valve means is held open for the period of time that the primary actuator is displaced to said second position up to the selected time limit.

3. The food dispenser in accordance with claim 1 wherein said primary actuator timer circuitry includes means for selectively changing the selected time limit.

4. The food dispenser in accordance with claim 1 wherein said valve means includes a pinch valve solenoid supported relative to the frame and electrically connected with the valve control circuitry, the solenoid having a central rod moveable between open and closed positions relative to the delivery conduit for opening and closing the delivery conduit and a spring biasing the rod in the closed position.

5. The food dispenser in accordance with claim 4 wherein the valve control circuitry comprises primary actuator switch means responsive to the primary actuator timer circuitry for connecting the solenoid with the power input means to supply power to the solenoid to open the delivery conduit during the period of time that the primary actuator is displaced to said second portion up to the selected time limit.

6. The food dispenser in accordance with claim 5 wherein the primary actuator switch means includes:

(a) a switching transistor having main terminals, and a base connected with and responsive to the primary actuator timer circuitry for switching the transistor into a conductive state during the period of time that the primary actuator is displaced to said second position up the selected time limit; and (b) a relay having a relay coil connected in series with the main terminals of the switching transistor and a relay contact connected in series with the pinch valve solenoid so that the relay coil is energized to close the relay contact and connect the pinch valve solenoid with the power input means to open the delivery conduit during the period of time that the primary actuator is displaced to said second position up to the selected time limit.

7. A food dispenser comprising:

a vessel for containing food capable of flow;

a delivery conduit for delivering a flow of food from the vessel and having valve means for regulating the flow of food through the delivery conduit;

a primary actuator displaceable for actuating the valve means to enable a flow of food through the delivery conduit;

valve control circuitry responsive to displacement of the primary actuator for opening the valve means during the period of time that the primary actuator is displaced up to a selected time limit, the valve control circuitry having primary actuator timer circuitry for determining the selected time limit;

a secondary actuator displaceable for actuating the valve means, wherein the valve control circuitry is responsive to the displacement of the secondary actuator to open the valve means for a predetermined time limit following displacement of the secondary actuator, the valve control circuitry having secondary actuator timer circuitry for determining the predetermined time limit.

8. The food dispenser in accordance with claim 7 wherein said valve control circuitry includes force timer circuitry for enabling increased force to be supplied to the valve means for an initial predetermined time following deplacement of each actuator to facilitate the initial opening of the valve means and for enabling reduced force to be supplied to the valve means after the initial predetermined time expires, whereby the valve means is held open.

9. The food dispenser in accordance with claim 8 wherein said valve means includes a pinch valve solenoid electrically connected with the valve control circuitry, the solenoid having a central rod moveable between open and closed positions relative to the delivery conduit for opening and closing the delivery conduit and a spring biasing the rod to the closed position.

10. The food dispenser in accordance with claim 9 wherein the valve control circuitry comprises primary actuator switch means responsive to the primary actuator timer circuitry for energizing the solenoid to open the delivery conduit during the period of time that the primary actuator is displaced up to the selected time limit.

11. The food dispenser in accordance with claim 10 wherein the primary actuator switch means includes:

(a) a switching transistor having main terminals, and a base connected with and responsive to the primary actuator timer circuitry for switching the transistor into a conductive state during the period of time that the primary actuator is displaced up to the selected time limit; and (b) a relay having a relay coil connected in series with the main terminals of the switching transistor and a relay contact connected in series with the pinch valve solenoid so that the relay coil is energized to close the relay contact and energize the pinch valve solenoid to open the delivery conduit during the period of time that the primary actuator is displaced up to the selected time limit.

12. The food dispenser in accordance with claim 9 wherein the solenoid includes a center tap and the valve control circuitry comprises primary force switch means connected with the center tap and an end of the solenoid responsive to the primary force timer circuitry to electrically short-circuit a portion of the pinch valve solenoid for the initial predetermined time period following actuation of the primary actuator to provide an increased actuating force on the rod to facilitate the initial opening of the rod against the bias of the spring and to remove the short-circuit to reduce the force on the rod after the initial predetermined time period expires to enable the rod to be held in the open position against the bias of the spring for the period of time that the primary actuator is displaced up to the selected time limit.

13. The food dispenser in accordance with claim 12 wherein the primary force switch means includes:

(a) a switching transistor having main terminals, and a base connected for switching the transistor into a conductive state during the initial predetermined period following displacement of the primary actuator; and (b) a relay having a relay coil connected in series with the main terminals of the switching transistor and a relay contact connected across the center tap and the end of the pinch valve solenoid so that the relay coil is energized to close the relay contact to electrically short-circuit the portion of the solenoid to provide the increased actuating force on the rod during the initial predetermined time period following displacement of the primary actuator.

14. The food dispenser in accordance with claim 9 wherein the valve control circuitry comprises secondary actuator switch means responsive to the secondary actuator timer circuitry for energizing the solenoid to open the delivery conduit for the predetermined time limit following displacement of the secondary actuator.

15. The food dispenser in accordance with claim 14 wherein the secondary actuator switch means includes:

(a) a switching transistor having main terminals, and a base connected with and responsive to the secondary actuator timer circuitry for switching the transistor into a conductive state for the predetermined time limit following displacement of the secondary actuator; and (b) a relay having a relay coil connected in series with the main terminals of the switching transistor and a relay contact connected in series with the pinch valve solenoid so that the relay coil is energized to close the relay contact and energize the pinch valve solenoid to open the delivery conduit for the predetermined time limit following displacement of the secondary actuator.

16. The food dispenser in accordance with claim 9 wherein the solenoid includes a center tap and the valve control circuitry comprises secondary force switch means connected with the center tap and an end of the solenoid responsive to the secondary force timer circuitry to electrically short-circuit a portion of the solenoid for the initial predetermined time following displacement of the secondary actuator to provide an increased actuating force on the rod to facilitate the initial opening of the rod against the bias of the spring and to remove the short-circuit to reduce the force on the rod after the initial predetermined time expires to enable the rod to be held in the open position against the bias of the spring for the predetermined time limit provided by said secondary actuator timer circuitry.

17. The food dispenser in accordance with claim 16 wherein the secondary force switch means includes:

(a) a switching transistor having main terminals, and a base connected with and responsive to the secondary force timer circuitry for switching the transistor into a conductive state during the initial predetermined time following displacement of the secondary actuator; and (b) a relay having a relay coil connected in series with the main terminals of the switching transistor and a relay contact connected across the center tap and the end of the pinch valve solenoid so that the relay coil is energized to close the relay contact to electrically short-circuit the portion of the solenoid to provide the increased actuating force on the rod during the initial predetermined time following displacement of the secondary actuator.

18. A food dispenser comprising:

(a) a frame;

(b) a vessel supported relative to the frame for containing food;

(c) a delivery conduit supported relative to the frame communicating with the vessel for delivering a flow of food from the vessel;

(d) valve means supported relative to the frame cooperating with the delivery conduit for regulating the flow of food through the delivery conduit;

(e) a primary actuator displaceable from a first position to a second position for actuating the valve means to enable a flow of food through the delivery conduit;

(f) power input means for providing a supply of electrical power;

(g) valve control circuitry connected with the power input means and the valve means responsive to displacement of the primary actuator to the second position for supplying electrical power to the valve means to open the valve means to permit a flow of food through the delivery conduit, the valve control circuitry having primary force timer circuitry for enabling increased force to be supplied to the valve means for an initial predetermined time period following displacement of the primary actuator to the second position to facilitate the initial opening of the valve means and for enabling reduced force to be supplied to the valve means after the initial predetermined time period expires to enable the valve means to be held open for a selected period of time, said timer circuitry including reset means responsive to a reset signal, displacement of the primary actuator to its first position providing said reset signal.

19. The food dispenser in accordance with claims 1 or 18, wherein said vessel is thermally-conductive, and said dispenser comprises heat-exchange means connected with the power input means and thermally-coupled with the vessel to enable heat transfer between the vessel and the heat exchange means to regulate the temperature of the food in the vessel.

20. The food dispenser in accordance with claim 19 wherein said heat exchange means includes an electrically powered thermoelectric heat transfer module for converting electrical power to thermal energy, the module being electrically connected with the power input means and thermally coupled with the vessel to effect heat transfer between the thermoelectric module and the vessel.

21. The food dispenser in accordance with claim 19 wherein the heat exchange means includes a heat exchange assembly thermally coupled with the vessel to effect heat transfer between the heat exchange assembly and the vessel, the heat exchange assembly including:

(a) an electrically powered thermoelectric heat transfer module electrically connected with the power supply means for converting electrical power to thermal energy, the module having a first side for extracting heat and a second side for radiating heat;

(b) a thermally-conductive shoe in contact with the first side of the thermoelectric module and in thermal contact with the vessel to enable heat transfer between the module and the vessel;

(c) a heat sink in thermal contact with the second side of the module to enable heat to be radiated from the module; and (d) means for holding the thermoelectric module in thermal contact with the shoe and the heat sink.

22. The food dispenser in accordance with claim 21 wherein said heat sink includes a plurality of heat radiating fins projecting from the second side of the module into ambient air for radiating heat from the thermoelectric module to ambient air.

23. The food dispenser in accordance with claim 21 wherein said heat exchange means includes an air pump supported relative to the frame for creating a flow of ambient air through the heat sink to increase heat radiation from the heat sink to the ambient air.

24. The food dispenser in accordance with claim 23 wherein said air pump includes an electrically-powered fan electrically connected with the power input means.

25. The food dispenser in accordance with claim 23 wherein said frame includes housing means for generally enclosing the heat exchange assembly, said housing having air inlet means and air outlet means and wherein said air pump intakes a flow of ambient air through the air inlet means, creates a flow of the ambient air through the heat sink, and exhausts the ambient air through the outlet means of the housing.

26. The food dispenser in accordance with claim 18 wherein said valve means includes a pinch valve solenoid supported relative to the frame and electrically connected with the valve control circuitry, the solenoid having a central rod moveable between open and closed positions relative to the delivery conduit for opening and closing the delivery conduit and a spring biasing the rod to the closed position.

27. The food dispenser in accordance with claim 26 wherein the solenoid includes a center tap and the valve control circuitry comprises primary force switch means connected with the center tap and an end of the solenoid responsive to the primary force timer circuitry to electrically short-circuit a portion of the pinch valve solenoid for the initial predetermined time period following displacement of the primary actuator to said second position to provide an increased actuating force on the rod to facilitate the initial opening of the rod against the bias of the spring, and to remove the short-circuit to reduce the force on the rod after the initial predetermined time period expires to enable the rod to be held in the open position against the bias of the spring for the selected period of time controlled by the primary actuator.

28. The food dispenser in accordance with claim 27 wherein the primary force switch means includes:

(a) a switching transistor having main terminals, and a base connected with and responsive to the primary force timer circuitry for switching the transistor into a conductive state during the initial predetermined time period following displacement of the primary actuator to its second position; and (b) a relay having a relay coil connected in series with the main terminals of the switching transistor and a relay contact connected across the center tap and the end of the pinch valve solenoid so that the relay coil is energized to close the relay contact to electrically short-circuit the portion of the solenoid to provide the increased pulling force on the rod during the initial predetermined time period following displacement of the primary actuator to said second position.

* * * * *